US007191481B2

(12) United States Patent
Hsu et al.

(10) Patent No.: US 7,191,481 B2
(45) Date of Patent: Mar. 20, 2007

(54) AIRBED

(76) Inventors: Hao Hsu, C 82 Diamond Village, Er Huan Road, Chang An, Dong Guan, Guang Dong (CN) 523850; Hsin Ping Wu, C 82 Diamond Village, Er Huan Road, Chang An, Dong Guan, Guang Dong (CN) 523850

( * ) Notice: Subject to any disclaimer, the term of this patent is extended or adjusted under 35 U.S.C. 154(b) by 79 days.

(21) Appl. No.: 11/020,915

(22) Filed: Dec. 22, 2004

(65) Prior Publication Data

US 2006/0130240 A1 Jun. 22, 2006

(51) Int. Cl.
*A47C 27/08* (2006.01)

(52) U.S. Cl. ..... 5/712; 5/731

(58) Field of Classification Search ..... 5/706, 5/710–712, 682, 932
See application file for complete search history.

(56) References Cited

U.S. PATENT DOCUMENTS 622,239 A * 4/1899 Lane ..... 5/712
1,970,502 A * 8/1934 Hamza ..... 5/712
2,016,054 A * 10/1935 Sentell ..... 5/712
4,328,599 A * 5/1982 Mollura ..... 5/682
4,679,264 A 7/1987 Mollura
4,826,715 A * 5/1989 Lee ..... 428/64.1
5,606,756 A 3/1997 Price
6,463,610 B1 10/2002 Shulte et al.
D490,635 S 6/2004 Boso et al.
6,793,469 B2 9/2004 Chung

* cited by examiner

*Primary Examiner*—Michael Trettel
(74) *Attorney, Agent, or Firm*—Conley Rose, P.C.

(57) ABSTRACT

This invention provides an improved bed. The bed comprises a top sheet, a bottom sheet connected with the top sheet, and at least one coil beam. The coil beam further comprises a first fastener attached to the top sheet, a second fastener attached to the bottom sheet, and a string connecting the first and second fasteners. In one embodiment, the first fastener further comprises a first attachment sheet with two first openings and a first bridge formed therebetween. The first attachment sheet is welded onto the top sheet. The string runs through the two first openings between the first bridge and the top sheet. In addition, the second fastener further comprises a second attachment sheet with two second openings and a second bridge formed therebetween. The second attachment sheet is welded onto the bottom sheet. The string runs through the two second openings between the second bridge and the bottom sheet.

19 Claims, 3 Drawing Sheets

AIRBED

FIELD OF INVENTION

The present invention relates to beds, specifically to an airbed using coil beam connections.

BACKGROUND OF INVENTION

Airbeds are well known in the art and have proven themselves to be very useful. On the one hand, when there is no need to use the airbed, the owner may simply deflate the airbed (i.e., let all the air out), fold it up, and then store it away in a closet or basement. On the other hand, when guests arrive or when the owner of the airbed takes a trip to a place where there is no bed to sleep on, the owner may simply inflate the airbed and sleep on it.

Current airbeds typically use polyvinyl chloride (PVC) to make the top sheet, the bottom sheet, the side sheet and the connection part between the top sheet and the bottom sheet. However, such airbeds have the disadvantage of not being cost effective because of the material they use.

It is therefore the object of the present invention to provide an improved airbed.

SUMMARY OF INVENTION

This invention provides an improved bed. The bed comprises a top sheet, a bottom sheet connected with the top sheet, and at least one coil beam. The coil beam further comprises a first fastener attached to the top sheet, a second fastener attached to the bottom sheet, and a string connecting the first and second fasteners. In one embodiment, the first fastener further comprises a first attachment sheet with two first openings and a first bridge formed therebetween. The first attachment sheet is welded onto the top sheet. The string runs through the two first openings between the first bridge and the top sheet. In addition, the second fastener further comprises a second attachment sheet with two second openings and a second bridge formed therebetween. The second attachment sheet is welded onto the bottom sheet. The string runs through the two second openings between the second bridge and the bottom sheet.

This invention further provides a method of producing a bed. The method comprises attaching at least one first fastener with a top sheet, attaching at least one second faster with a bottom sheet, and respectively connecting the first fastener and the second fastener with a string.

One of the major advantages of the present invention is that it provides the string to connect the first and second fasteners. Since the string can be any kind of inexpensive and light weight material as long as it is strong and certainly cheaper than PVC, the present invention is strong and cost effective and can be easily carried around. Therefore, the present invention provides an improved bed which is stronger, more cost-effective and less heavy.

DETAILED DESCRIPTION

Figure 1:
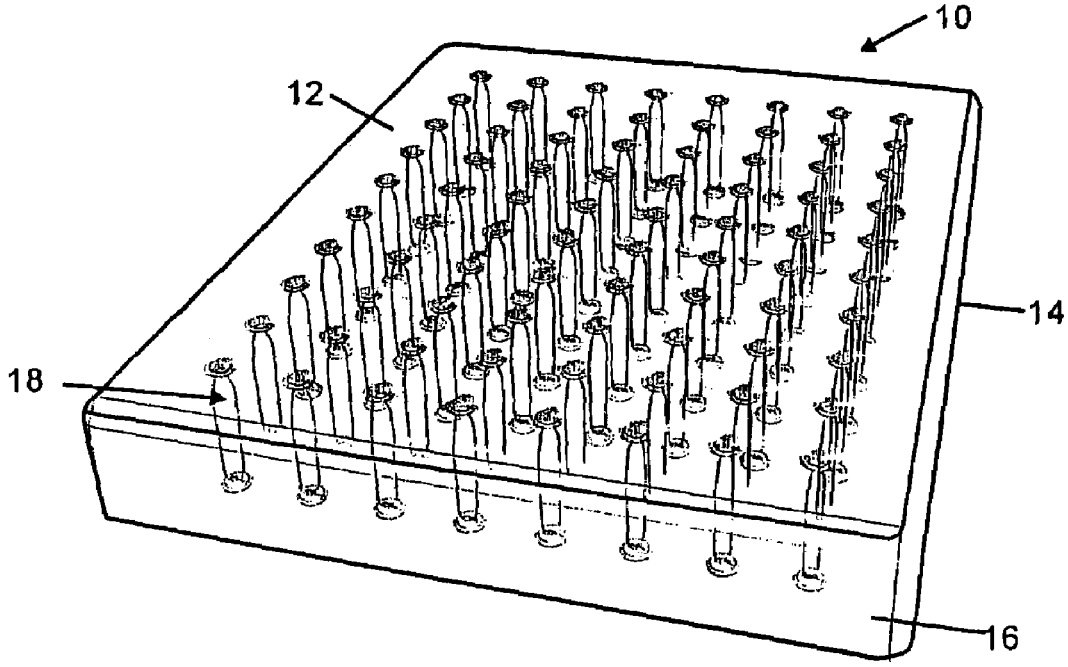
FIG. 1 is a perspective diagram illustrating the overall configuration of one embodiment of the present invention.

Referring to FIG. 1, in the exemplary embodiment, the exterior of the airbed 10 of the present invention may be of any design known in the art. The airbed 10 of the exemplary embodiment includes a top sheet 12, a bottom sheet 14, and a side sheet 16. Typically, the top edges of the side sheet 16 are connected to the edges of the top sheet 12 and the bottom edges of the side sheet 16 are connected to the edges of bottom sheet 14 such that the airbed 10 forms a gas chamber upon inflation.

As shown in FIG. 1, there are also coil beams 18 located throughout the interior of the airbed 10 which are connected on one end to the top sheet 12 and on the other end to the bottom sheet 14. The coil beams 18 can maintain the shape of the airbed 10 by preventing the various portions of the top sheet 12 or the bottom sheet 14 from stretching out too far (for example, into a balloon shape) when air is pumped therein.

Figure 2:
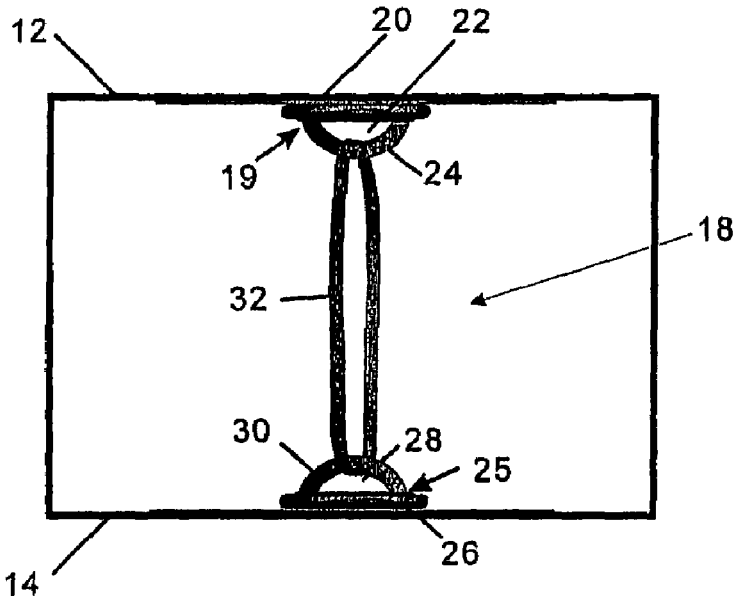
FIG. 2 is a front view of a coil beam of the same embodiment of the present invention.
Figure 3A:
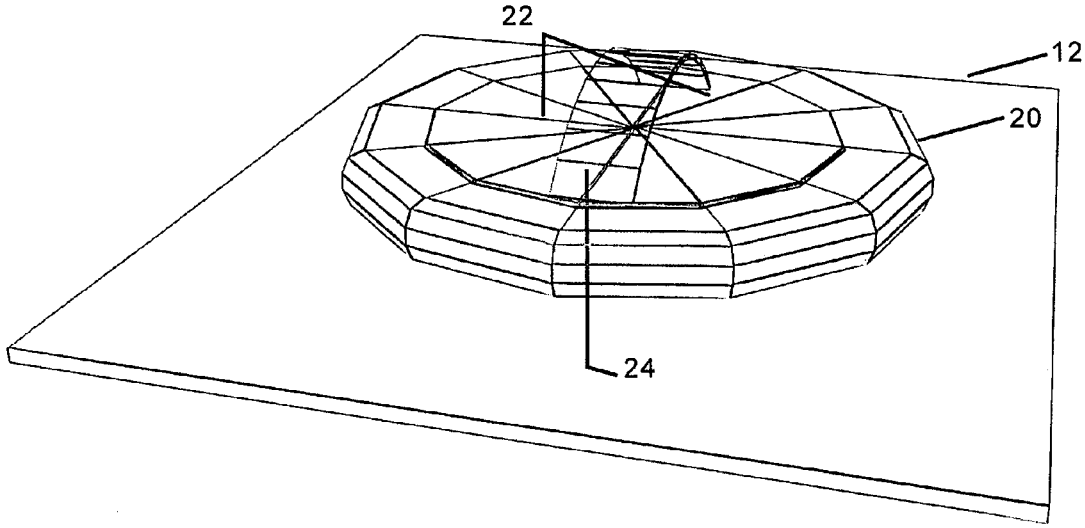
FIGS. 3A and 3B are plan views of the coil beam of the same embodiment of the present invention.
Figure 3B:
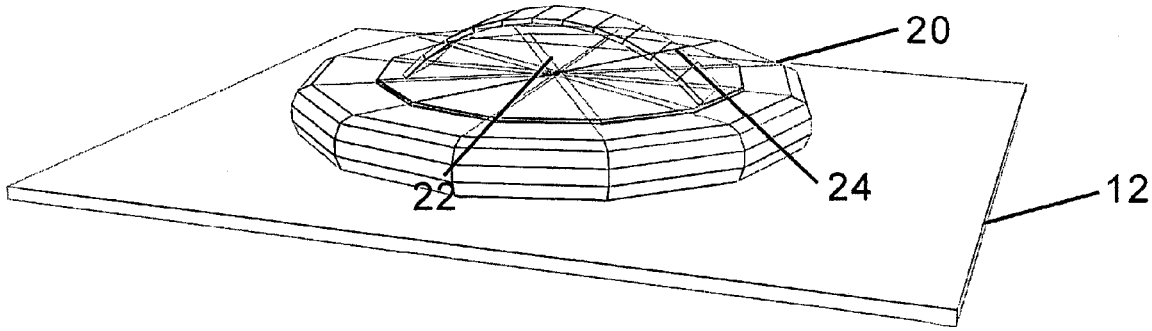

The detailed structure of the coil beams 18 is shown in FIG. 2 and FIGS. 3A and 3B, respectively in a front view and in plan views. According to this embodiment of the present invention, the coil beams 18 includes a first fastener 19 attached to the top sheet 12, a second fastener 25 attached to the bottom sheet 14, and a string 32 connecting the first fastener 19 and second fastener 25. In particular, the first fastener 19 includes a first attachment sheet 20 with two first openings 22 and a first bridge 24 formed therebetween. Typically, the first attachment sheet 20 is welded onto the top sheet 12, and the string 32 runs through the two first openings 22 between the first bridge 24 and the top sheet 12. Similarly, the second fastener 25 includes a second attachment sheet 26 with two second openings 28 and a second bridge 30 formed therebetween. The second attachment sheet 26 is welded onto the bottom sheet 14, and the string 32 runs through the two second openings 28 between the second bridge 30 and the bottom sheet 14. When the air is pumped, the force between the string 32 and the first and second bridges 24 and 30 can prevent the various portions of the top sheet 12 or the bottom sheet 14 from stretching out too far, thus the pumped airbed can be used as a flat mattress. In this embodiment of the invention, the first fastener 19 and the second fastener 25 are respectively evenly spread on the top sheet 12 and the bottom sheet 14.

Figure 4:
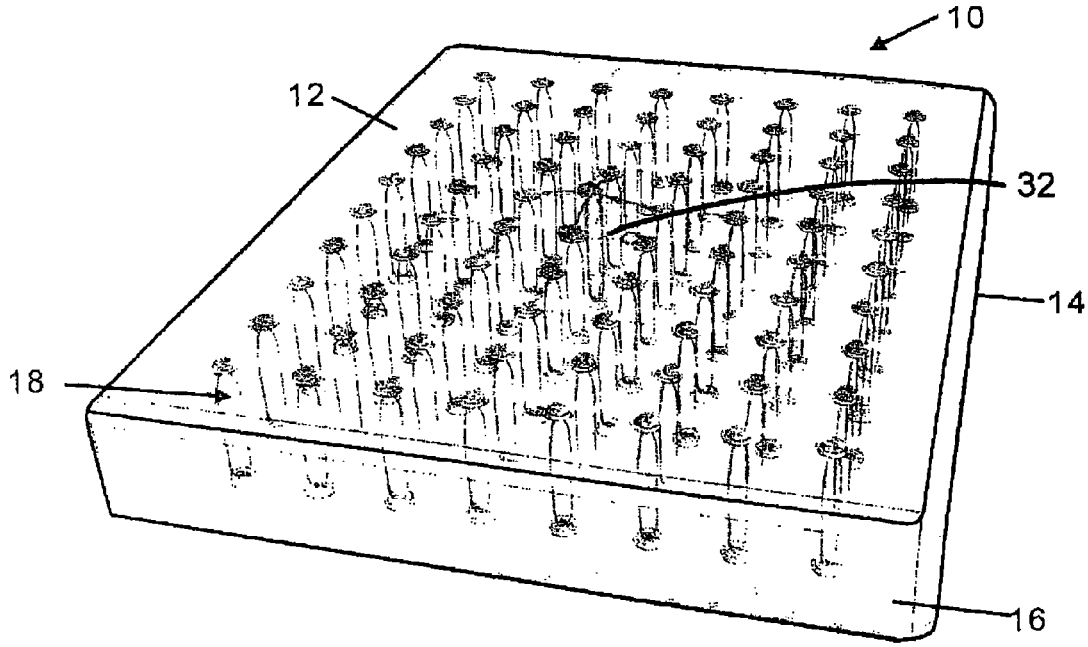
FIG. 4 is a perspective diagram illustrating the configuration of another embodiment of the present invention.

After respectively guiding the string 32 through the two first openings 22 and the two second openings 28, the airbed producer typically ties the two ends of the string 32 to connect the first and second fasteners together. According to this embodiment of the present invention, the string 32 of each of the coil beams 18 is tied to the top sheet 12 and bottom sheet 14 to form the same distance therebetween so that the airbed 10 has flat to and bottom sides when air is pumped therein. Alternatively, the airbed producer can adjust the distance between the top sheet 12 and bottom sheet 14 around a particular location to form a curved shape at that particular location when air is pumped. For example, where the airbed user needs stronger waist support, the airbed producer can use a longer string 32 between the top sheet 12 and bottom sheet 14 around the waist location of the airbed 10 to form a bulk shape when air is pumped, as seen in FIG. 4.

According to this embodiment of the present invention, the airbed producer can first respectively weld the first attachment sheet 20 onto the top sheet 12 and the second attachment sheet 26 onto the bottom sheet 14, then run the string 32 through the two first openings 22 and the two second openings 28, and further to tie the two ends of the string 32 to connect the first and second fasteners together. Alternatively, the sequence of producing the airbed 10 can be changed depending on the convenience of the producer. For example, the airbed producer can first run the string 32 through the two first openings 22 and the two second openings 28, then tie the two ends of the string 32 to connect the first and second fasteners together, and later to weld the first attachment sheet 20 and the second attachment sheet 26 to the sheets.

Typically, the top sheet 12, the bottom sheet 14 and the side sheet 16 are made from any material such as PVC, Tarpaulin (which is composed by top and bottom PVC film with middle nylon mesh laminated), Hipline, PE, PEVA, EVA, fabric with PVC backing, fabric with PEVA backing, etc. The first fastener 19 and the second fastener 25 are preferably made from the same material as the sheets for easy production and better attachment with the sheets. Alternatively, the first fastener 19 and the second fastener 25 can be made from other material as long as the fasteners 19 can 25 can be firmly attached to the sheets. The string 32, however, can be made from any material as long as it is strong enough to maintain the connection between the first fastener 19 and the second fastener 25 when the airbed 10 is inflated. Typically, the string 32 can be made from inexpensive and light material such as nylon to reduce the cost and weight of the airbed 10.

The present invention has certain advantages over the current airbeds. For example, since the string 32 can be any kind of inexpensive and light material as long as it is strong, such as nylon, PE, PP, or PVC, the present invention is strong and cost effective and can be easily carried around. In addition, the present invention can provide extra support for a particular body part by simply adjusting the corresponding part distance between the top sheet 12 and bottom sheet 14 without incurring extra cost.

The present invention has been described in detail herein in accordance with certain preferred embodiments thereof. To fully and clearly describe the details of the invention, certain descriptive names were given to the various components. It should be understood by those skilled in the art that these descriptive terms were given as a way of easily identifying the components in the description, and do not necessarily limit the invention to the particular description. For example, the bed can be airbed in any shape, sofa-bed, any bed (inflatable or not) or any inflatable apparatus that uses the structure described in this application. The top sheet 12, the bottom sheet 14, and the side sheet 16 can all be made of one piece. The fasteners 19 and 25 can be in any shape as long as they can provide openings for the connection purpose. In addition, the fasteners 19 and 25 can be spread on the sheets 12 and 14 for any kind of design. Further, the attachment sheets 20 and 26 can be attached to the sheets using any kind of technology including welding. Therefore, many such modifications are possible. Accordingly, it is intended by the appended claims to cover all such modifications and changes as falling within the true spirit and scope of the present invention.

I claim

1. An improved bed comprising:

a top sheet;

a bottom sheet connected with said top sheet; and a plurality of coil beams, wherein at least one of said coil beams further comprising:

a first bridge attached to said top sheet, said first bridge defining an opening between said first bridge and said top sheet for receiving a string; and a second bridge attached to said bottom sheet, said second bridge defining an opening between said second bridge and said bottom sheet for receiving said string;

wherein said string connects said first and second bridges;

wherein said bed is adapted to be filled with air; and wherein at least one of said coil beams is longer than the other of said coil beams.

2. The bed of claim 1 further comprising a side sheet for connecting said top sheet with said bottom sheet.

3. The bed of claim 1, wherein said first bridge further comprises a first attachment sheet, said first attachment sheet being welded onto said top sheet, said string running through said first bridge opening between said first bridge and said top sheet.

4. The bed of claim 1, wherein said second bridge further comprises a second attachment sheet, said second attachment sheet being welded onto said bottom sheet, said string running through said second bridge opening between said second bridge and said bottom sheet.

5. The bed of claim 1, wherein said string of each of said coil beams is tied to said top and bottom sheets to form a fixed distance therebetween.

6. The bed of claim 1, wherein said first and second bridges are respectively evenly spread on said top and bottom sheets.

7. The bed of claim 1, wherein said top sheet, said bottom sheet, said first bridge and said second bridge are made from polyvinyl chloride (PVC).

8. The bed of claim 1 wherein said coil beams are fully collapsible such that said top and bottom sheets are in substantial contact.

9. The bed of claim 1 wherein the longer coil beam is at the waist location of the bed.

10. An improved airbed comprising:

a top sheet;

a bottom sheet;

a side sheet for connecting said top sheet with said bottom sheet;

a plurality of first bridges each comprising a first attachment sheet, said first attachment sheet being welded onto said top sheet such as to define an opening between said first bridge and said top sheet for receiving a string;

a plurality of second bridges each comprising a second attachment sheet, said second attachment sheet being welded onto said bottom sheet such as to define an opening between said second bridge and said bottom sheet for receiving a string; and a plurality of strings each respectively running through said first opening between said first bridge and said top sheet and through said second opening between said second bridge and said bottom sheet to connect said first and second bridges, wherein at least one string is longer than the other of said strings, whereby the shape of a mattress is formed when air is pumped therein.

11. The airbed of claim 10, wherein said top sheet, said bottom sheet, said side sheet, said first bridges and said second bridges are made from PVC.

12. The airbed of claim 10 wherein said airbed is fully collapsible such that said top and bottom sheets are in substantial contact.

13. The bed of claim 10, wherein the longer string is at the waist location of the bed.

14. A method of producing a bed comprising:

attaching a plurality of first bridges with a top sheet to define a plurality of openings between said first bridges and said top sheet;

attaching a plurality of second bridges with a bottom sheet to define a plurality of openings between said second bridge and said bottom sheet; and respectively connecting said first bridges and said second bridges with a plurality of strings, wherein at least one of said strings is longer than the other of said strings.

15. The method of claim 14 further comprising connecting said top sheet with said bottom sheet by a side sheet.

16. The method of claim 15 further comprising pumping air into said connected top, bottom and side sheets.

17. The method of claim 14 wherein respectively connecting further comprises respectively running said strings through said openings of said first bridges and said second bridges.

18. The method of claim 14 further comprising collapsing said connected first and second bridges such that said top and bottom sheets are in substantial contact.

19. The method of claim 14, wherein the longer string is at the waist location of the bed.

* * * * *